US006803936B2

(12) United States Patent
Odaka et al.

(10) Patent No.: US 6,803,936 B2
(45) Date of Patent: Oct. 12, 2004

(54) THERMAL TRANSFER SHEET, METHOD FOR IMAGE FORMATION, METHOD FOR IMAGE-FORMED OBJECT FORMATION, AND IMAGE-FORMED OBJECT

(75) Inventors: Tsuaki Odaka, Tokyo-To (JP); Kenji Sakamoto, Tokyo-To (JP); Katsuyuki Oshima, Tokyo-To (JP); Tatsuya Kita, Tokyo-To (JP); Kazuhiro Masuda, Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 22 days.

(21) Appl. No.: 10/383,879

(22) Filed: Mar. 10, 2003

(65) Prior Publication Data

US 2003/0174197 A1 Sep. 18, 2003

(30) Foreign Application Priority Data

Mar. 8, 2002 (JP) ..... 2002-063147
Feb. 20, 2003 (JP) ..... 2003-042712

(51) Int. Cl.[7] ..... B41J 2/325; B41J 31/00

(52) U.S. Cl. ..... 347/213; 347/217; 428/32.79

(58) Field of Search ..... 347/213, 217; 428/32.6, 32.64, 32.77, 32.78, 32.79

(56) References Cited

U.S. PATENT DOCUMENTS

| | | | | | |
|---|---|---|---|---|---|
| 4,923,848 | A | * | 5/1990 | Akada et al. | 503/227 |
| 5,053,788 | A | * | 10/1991 | Tohdo | 347/217 |
| 5,198,296 | A | * | 3/1993 | Suzuki et al. | 428/32.79 |
| 5,447,902 | A | * | 9/1995 | Imai et al. | 503/227 |
| 5,456,969 | A | * | 10/1995 | Suzuki et al. | 428/32.79 |
| 6,290,798 | B1 | * | 9/2001 | Onishi et al. | 156/230 |
| 2002/0000286 | A1 | | 1/2002 | Onishi et al. | 156/234 |

FOREIGN PATENT DOCUMENTS

| | | |
|---|---|---|
| EP | 0 992 360 A2 | 4/2000 |
| JP | 07 246783 A | 9/1995 |
| JP | 08 066999 A | 3/1996 |
| JP | 2000 190636 A | 7/2000 |
| JP | 2001 121831 A | 5/2001 |

* cited by examiner

*Primary Examiner*—Huan Tran
(74) *Attorney, Agent, or Firm*—Parkhurst & Wendel, L.L.P.

(57) ABSTRACT

An image formation method and a thermal transfer sheet for use in the image formation method are provided. According to the image formation method and the thermal transfer sheet, an intermediate transfer recording medium comprising a substrate film and a transfer part, comprising at least a receptive layer, provided separably on the substrate film is used, and, at the time of the transfer of the transfer part in the intermediate transfer recording medium onto an object, the transfer of the transfer part onto the object in its nontransfer region, onto which the transfer part should not be transferred, can be avoided without installing any special ancillary tool on an image forming apparatus. In the method for image formation, a thermal transfer sheet comprising a substrate and at least a peel-off layer provided on the substrate is provided. Further, an intermediate transfer recording medium comprising a substrate film and a transfer part, comprising at least a receptive layer, provided separably on the substrate film is provided. The thermal transfer sheet and the intermediate transfer recording medium are put on top of each other so that the peel-off layer in the thermal transfer sheet is brought into contact with the transfer part in the intermediate transfer recording medium. The assembly is heated to remove the transfer part in its predetermined region from the intermediate transfer recording medium. The transfer part is then retransferred from the intermediate transfer recording medium onto an object. That is, the transfer part in its predetermined region in the intermediate transfer recording medium is transferred onto the thermal transfer sheet side provided with the peel-off layer and is separated from the intermediate transfer recording medium side.

18 Claims, 3 Drawing Sheets

THERMAL TRANSFER SHEET, METHOD FOR IMAGE FORMATION, METHOD FOR IMAGE-FORMED OBJECT FORMATION, AND IMAGE-FORMED OBJECT

TECHNICAL FIELD

The present invention relates to a thermal transfer sheet, a method for image formation, a method for image-formed object formation, and an image-formed object. According to the present invention, an intermediate transfer recording medium comprising a substrate film and a transfer part, comprising at least a receptive layer, provided separably on the substrate film is used, and, at the time of the transfer of the transfer part in the intermediate transfer recording medium onto an object, the transfer of the transfer part onto the object in its nontransfer region, onto which the transfer part should not be transferred, can be avoided without installing any special ancillary tool on an image forming apparatus.

BACKGROUND ART

A thermal transfer method has become extensively used as a simple printing method. In the thermal transfer method, a thermal transfer sheet, comprising a colorant layer provided on one side of a substrate sheet, is put on top of a thermal transfer image-receiving sheet optionally provided with an image-receptive layer. The backside of the thermal transfer sheet is heated image-wise by heating means such as a thermal head to selectively transfer the colorant contained in the colorant layer to form an image on the thermal transfer image-receiving sheet.

Thermal transfer methods are classified into thermal ink transfer (hot melt-type thermal transfer) and thermal dye sublimation transfer (sublimation-type thermal transfer). Image formation by the thermal transfer method is carried out as follows. A thermal transfer sheet comprising a substrate sheet, such as a PET film, and, supported on the substrate sheet, a heat-fusion ink layer, formed of a dispersion of a colorant, such as a pigment, in a binder, such as a hot-melt wax or resin, is first provided. Energy according to image information is then applied to heating means such as a thermal head to transfer the colorant together with the binder onto a thermal transfer image-receiving sheet such as paper or plastic sheets. Images produced by the thermal ink transfer have high density and possess high sharpness and are suitable for recording binary images of characters or the like.

On the other hand, the thermal dye sublimation transfer is a method for image formation which is carried out as follows. A thermal transfer sheet comprising a substrate sheet, such as a PET film, and, supported on the substrate sheet, a dye layer formed of a dye, which is mainly thermally transferred by sublimation and has been dissolved or dispersed in a resin binder, is first provided. Energy according to image information is then applied to heating means such as a thermal head to transfer only the dye onto a thermal transfer image-receiving sheet comprising a substrate sheet, such as paper or a plastic, optionally provided with a dye-receptive layer. The thermal dye sublimation transfer can regulate the amount of the dye transferred according to the quantity of energy applied and thus can form gradation images of which the image density has been regulated dot by dot of the thermal head. Further, since the colorant used is a dye, the formed image is transparent, and the reproduction of intermediate colors produced by superimposing different color dyes on top of each other or one another is excellent. Accordingly, high-quality photograph-like full color images can be formed with faithful reproduction of intermediate colors by transferring different color dyes, such as yellow, magenta, cyan, and black, onto a thermal transfer image-receiving sheet, so as to superimpose the color dyes on top of each other or one another, from a thermal transfer sheet of the different colors.

Thermal transfer image-receiving sheets used with these thermal transfer methods have a wide variety of practical applications. Representative examples of applications include proof sheets, and recording sheets for output images, output plans or designs drawn by CAD/CAM or the like, or images output from a variety of medical analyzers or measuring instruments such as CT scanners and endoscopic cameras. They can also be used as the alternative of instant photographs, and as paper for producing identity certifications, ID cards, credit cards, and other cards on which facial photographs or the like are printed, or for producing synthetic or memorial photographs which are taken at amusement facilities such as recreation parks, game centers, museums, aquariums and the like. The diversification of the applications has led to an increasing demand for the formation of a thermally transferred image on a desired object. A method has been proposed as one method for meeting this demand. In this method, a colorant such as a dye or a pigment is transferred, from a thermal transfer sheet comprising a dye layer or a heat-fusion ink layer, onto a receptive layer in an intermediate transfer recording medium comprising the receptive layer separably provided on a substrate to form an image on the receptive layer. Thereafter, the intermediate transfer recording medium is heated to transfer the receptive layer, with the image formed thereon, onto an object (Japanese Patent Laid-Open No. 238791/1987 or the like).

Since the intermediate transfer recording medium can transfer the receptive layer onto an object, this method is preferably used, for example, for objects, onto which a colorant is less likely to be transferred, making it impossible to form high-quality images directly on them. Further, this method is preferably used for objects which are likely to be fused to the colorant layer at the time of thermal transfer. Therefore, the intermediate transfer recording medium can be advantageously used for the preparation of passports or other identity certifications, credit cards/ID cards, or other prints.

For some cards, an IC chip part, a magnetic stripe part, an antenna part for transmission/reception, a signature part or the like exists on an identical surface on which the receptive layer is to be transferred. These parts are a region where covering with the receptive layer transferred from the intermediate transfer recording medium adversely affects the function of this region.

On the other hand, for example, Japanese Patent Laid-Open Nos. 272849/1998 and 143831/1994 disclose a method and apparatus for image formation wherein a releasable ink is previously transferred onto an intermediate transfer recording medium to allow a receptive layer (an image layer) to lose its adhesion and thus to prevent the transfer of the image layer onto an object in its nontransfer region.

In the above method for image formation, however, the transfer of the receptive layer (image layer) onto an object in its nontransfer region (for example, an IC chip part or a signature part) cannot be fully prevented without difficulties. To overcome this drawback, for example, a sticking-and-removing mechanism for removing an unnecessary receptive layer adhered to the object has been installing on an image forming apparatus.

Unlike the conventional image forming apparatus, however, an apparatus for the sticking-and-removing mechanism or the like is a special apparatus, and the provision of this apparatus disadvantageously incurs very high cost.

Accordingly, it is an object of the present invention is to solve the above problems of the prior art and to provide a method for image formation and a thermal transfer sheet for use in said method, wherein an intermediate transfer recording medium comprising a substrate film and a transfer part, comprising at least a receptive layer, provided separably on the substrate film is provided, and, at the time of the transfer of the transfer part in the intermediate transfer recording medium onto an object, the transfer of the transfer part onto the object in its nontransfer region, onto which the transfer part should not be transferred, can be avoided without installing any special ancillary tool on an image forming apparatus.

SUMMARY OF THE INVENTION

The above object of the present invention can be attained by a thermal transfer sheet adapted for the formation of a thermal dye transfer image (i.e., sublimation type transfer) and/or a thermal ink transfer image (fusion type transfer) on a transfer part in an intermediate transfer recording medium, said intermediate transfer recording medium comprising a substrate film and a transfer part (i.e., a transferable portion), comprising at least a receptive layer, provided separably on the substrate film, said thermal transfer sheet being also adopted for use before the retransfer of the transfer part in the intermediate transfer recording medium onto an object, said thermal transfer sheet comprising a substrate and at least a peel-off layer provided on the substrate, said thermal transfer sheet being configured so that the transfer part in its predetermined region can be removed from the intermediate transfer recording medium by putting the thermal transfer sheet and the intermediate transfer recording medium on top of each other so that the peel-off layer in the thermal transfer sheet is brought into contact with the transfer part in the intermediate transfer recording medium and then heating the assembly.

The peel-off layer may be provided by coating separately from a dye layer for the formation of a thermal dye transfer image and/or a heat-fusion layer for the formation of a thermal ink transfer image on an identical surface of the substrate.

In a preferred embodiment of the present invention, the substrate in the thermal transfer sheet has been subjected to easy-adhesion treatment. In this case, the peel-off layer is an exposed region of the easy-adhesion treated surface. A heating layer covered with a material, which is not adhered to the transfer part in the intermediate transfer recording medium, may be provided by coating separately from the peel-off layer, the dye layer and/or the heat-fusion layer on an identical surface of the substrate. The heating layer is used for idle printing to heat only the peripheral portion of the predetermined region before the removal of the transfer part in its predetermined region from the intermediate transfer recording medium.

According to the present invention, there is provided a method for image formation, comprising the steps of: providing a thermal transfer sheet comprising a substrate and at least a peel-off layer provided on the substrate, and an intermediate transfer recording medium comprising a substrate film and a transfer part, comprising at least a receptive layer, separably provided on the substrate film; putting the thermal transfer sheet and the intermediate transfer recording medium on top of each other so that the peel-off layer in the thermal transfer sheet is brought into contact with the transfer part in the intermediate transfer recording medium; heating the assembly to remove the transfer part in its predetermined region from the intermediate transfer recording medium; and then retransferring the transfer part in the intermediate transfer recording medium onto an object.

In the above method, preferably, after or before the formation of a thermal dye transfer image and/or a thermal ink transfer image on any position of the transfer part in the intermediate transfer recording medium, a method is carried out wherein the thermal transfer sheet and the intermediate transfer recording medium are put on top of each other so as for the peel-off layer in the thermal transfer sheet to be brought into contact with the transfer part in the intermediate transfer recording medium, the assembly is heated to remove the transfer part in its predetermined region from the intermediate transfer recording medium, and the predetermined thermal transfer image region in the transfer part in the intermediate transfer recording medium is transferred onto the object to form an image on the object.

In a preferred embodiment of the present invention, before the removal of the transfer part in its predetermined region from the intermediate transfer recording medium, the peripheral portion of the predetermined region in the transfer part is heated by idle printing of a heating layer covered with a material which is not adhered to the transfer part.

Further, according to the present invention, there is provided a method for image-formed object formation, comprising the steps of: first providing an ancillary product or part on an object; providing a thermal transfer sheet comprising a substrate and at least a peel-off layer provided on the substrate, and an intermediate transfer recording medium comprising a substrate film and a transfer part, comprising at least a receptive layer, separably provided on the substrate film; after or before the formation of a thermal dye transfer image and/or a thermal ink transfer image on any position of the transfer part in the intermediate transfer recording medium, putting the thermal transfer sheet and the intermediate transfer recording medium on top of each other so that the peel-off layer in the thermal transfer sheet is brought into contact with the transfer part in the intermediate transfer recording medium and heating the assembly to remove the transfer part in its predetermined region from the intermediate transfer recording medium; registering the removed region in the transfer part of the intermediate transfer recording medium with the object in its region where the ancillary product or part has been provided; and retransferring the transfer part in the intermediate transfer recording medium onto the object to form an image-formed object.

In the present invention, the object may be a card or a booklet.

Further, in the present invention, the ancillary product may be an IC chip or a signature space, and the ancillary part may be a holo-CI mark (a corporate identity mark with a hologram).

Furthermore, according to the present invention, there is provided an image-formed object produced by the above method for image-formed object formation.

According to the present invention, in the method for image formation, a thermal transfer sheet comprising a substrate and at least a peel-off layer provided on the substrate is provided. Further, an intermediate transfer recording medium comprising a substrate film and a transfer part, comprising at least a receptive layer, provided separably on the substrate film is provided. The thermal transfer sheet and the intermediate transfer recording medium are put on top of each other so that the peel-off layer in the thermal transfer sheet is brought into contact with the transfer part in the intermediate transfer recording medium. The assembly is heated to remove the transfer part in its predetermined region from the intermediate transfer recording medium. The transfer part is then retransferred from the intermediate transfer recording medium onto an object.

Specifically, a predetermined region of the transfer part in the intermediate transfer recording medium is put on top of the peel-off layer in the thermal transfer sheet, and the assembly is heated to transfer the transfer part in its predetermined region onto the thermal transfer sheet side provided with the peel-off layer, that is, to separate the transfer part in its predetermined region from the intermediate transfer recording medium side. The transfer part in the intermediate transfer recording medium is then retransferred onto an object in such a state that the removed (separated) region in the transfer part of the intermediate transfer recording medium is in registration with the object in its nontransfer region, that is, in its region where an IC chip, a signature space or the like has been provided and, the transfer of the transfer part from the intermediate transfer recording medium poses a problem.

By virtue of the removal of the transfer part in its predetermined region in the intermediate transfer recording medium by utilizing the peel-off layer before the transfer of the transfer part onto an object, the transfer of the transfer part onto the nontransfer region, such as an IC chip or a signature space or a CI mark (corporate identity mark, particularly a hologram mark or the like) of a card company, in the object can be surely prevented, and, thus, the function of the IC chip, the signature space and the like is not deteriorated.

Further, in the method for image formation according to the present invention, a nontransfer region as a predetermined region for an IC chip, a signature space or the like can be simply formed on an object by using a thermal transfer sheet comprising at least a peel-off layer provided on a substrate without using any special mechanism or method, such as a sticking-and-removing mechanism, for removing an unnecessary part in the transfer part adhered to the object.

Further, in a preferred embodiment of the present invention, in use of the thermal transfer sheet provided with a peel-off layer, the thermal transfer sheet and the intermediate transfer recording medium are put on top of each other so as for the peel-off layer in the thermal transfer sheet to be brought into contact with the transfer part in the intermediate transfer recording medium, the assembly is heated, and, within 0.8 sec after the start of the heating, the peel-off layer is separated from the intermediate transfer recording medium. Further, preferably, the peel-off layer is separated from the transfer part in the intermediate transfer recording medium at a peel angle of less than 90 degrees.

According to the present invention, there is provided an image forming apparatus for forming, on an intermediate transfer recording medium, a thermal transfer image which is then retransferred onto ah object, said image forming apparatus comprising: means for disposing, in position, an intermediate transfer recording medium comprising a substrate film and a transfer part, comprising at least a receptive layer, separably provided on the substrate film and a thermal transfer sheet comprising a substrate and at least a peel-off layer provided on the substrate; means for forming a predetermined image on an intermediate transfer recording medium; means for transferring the predetermined image formed on the intermediate transfer recording medium onto an object; and means for, before or after the formation of the image on the intermediate transfer recording medium, removing the transfer part in its region corresponding to a nontransfer region by the peel-off layer in the thermal transfer sheet.

In a preferred embodiment of the present invention, this apparatus further comprises means for putting the thermal transfer sheet and the intermediate transfer recording medium on top of each other so as for the peel-off layer in the thermal transfer sheet to be brought into contact with the transfer part in the intermediate transfer recording medium, heating the assembly, and, within 0.8 sec after the start of the heating, separating the peel-off layer from the intermediate transfer recording medium in its transfer part. Further, preferably, the apparatus comprises means for separating the peel-off layer from the intermediate transfer recording medium in its transfer part at a peel angle of less than 90 degrees.

Further, in the present invention, the method for image formation may comprise the step of removing the transfer part in its region, which is likely to cause flash after retransfer, by the peel-off layer.

PREFERRED EMBODIMENT OF THE INVENTION

Figure 1:
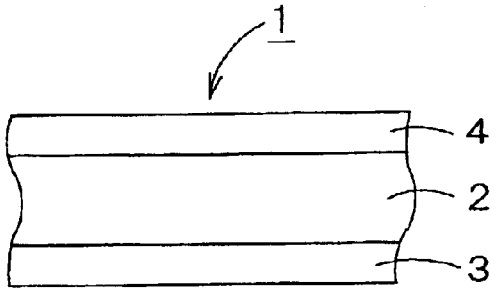
FIG. 1 is a schematic cross-sectional view showing one embodiment of the thermal transfer sheet according to the present invention.

FIG. 1 is a schematic cross-sectional view showing one embodiment of the thermal transfer sheet according to the present invention. In a thermal transfer sheet 1, a backside layer 4 for preventing fusing of the thermal transfer sheet to heating means, such as a thermal head, and for improving the slidability of the thermal transfer sheet is provided on one side of a substrate 2. A peel-off layer 3 is provided on the other side of the substrate 2.

Figure 2:
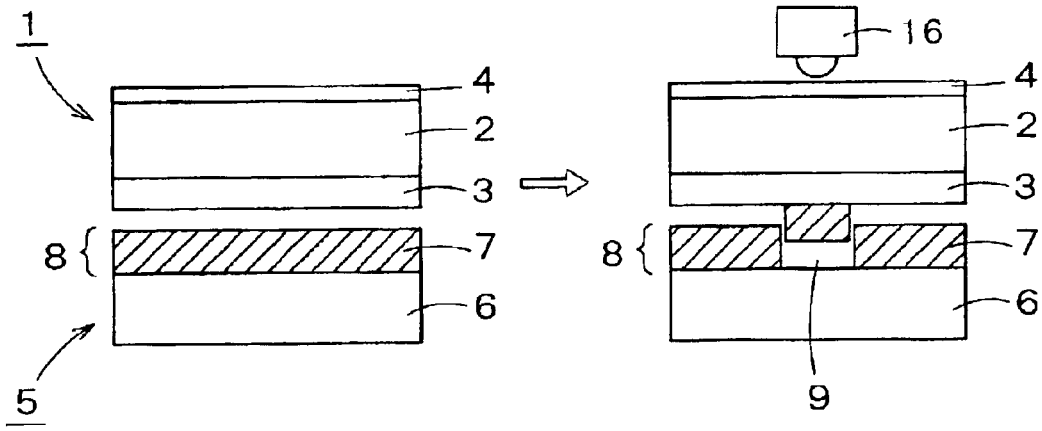
FIG. 2 is a schematic explanatory view of the thermal transfer sheet according to the present invention.

FIG. 2 is a schematic explanatory view of the thermal transfer sheet according to the present invention. An intermediate transfer recording medium 5 comprising a substrate film 6 and a transfer part 8, comprising a receptive layer 7, provided separably on the substrate film 6 is provided. Further, a thermal transfer sheet 1 comprising a substrate 2, a backside layer 4 provided on one side of the substrate 2, and a peel-off layer 3 provided on the other side of the substrate 2 is provided. The thermal transfer sheet 1 is put on top of the intermediate transfer recording medium 5 so that the peel-off layer 3 in the thermal transfer sheet 1 is brought into contact with the transfer part 8 in the intermediate transfer recording medium 5. In this state, the assembly can be heated by means of a thermal head 16 to remove the transfer part in its predetermined region 9 from the intermediate transfer recording medium 5. In this case, a thermal dye transfer image and/or a thermal ink transfer image are previously formed on the transfer part in the intermediate transfer recording medium.

Each layer constituting the thermal transfer sheet 1 will be described.

(Substrate)

The substrate 2 constituting the thermal transfer sheet is not particularly limited, and any substrate commonly used in conventional thermal transfer sheets as such may be used as the substrate 2. Specific examples of preferred substrates include: tissue papers, such as glassine paper, capacitor paper, and paraffin paper; and stretched or unstretched films of various plastics, for example, highly heat-resistant polyesters, such as polyethylene terephthalate, polyethylene naphthalate, polybutylene terephthalate, polyphenylene sulfide, polyether ketone, and polyether sulfone, polypropylene, polycarbonate, cellulose acetate, polyethylene derivatives, polyvinyl chloride, polyvinylidene chloride, polystyrene, polyamide, polyimide, polymethylpentene, and ionomers. A composite film formed of a laminate of two or more of the above materials may also be used. The thickness of the substrate may be properly selected depending upon materials for the substrate so that the substrate has proper strength, heat resistance and other properties. In general, however, the thickness is preferably about 1 to 25 $\mu$m.

(Backside Layer)

In the thermal transfer sheet, a backside layer 4 may be provided on the surface of the substrate remote from the peel-off layer from the viewpoints of preventing sticking of the thermal transfer sheet to a thermal head or the like and of improving the slipperiness against the thermal head or the like.

Examples of resins usable for the backside layer include naturally occurring or synthetic resins, for example, cellulosic resins, such asethylcellulose, hydroxycellulose, hydroxypropylcellulose, methylcellulose, cellulose acetate, cellulose acetate butyrate, and nitrocellulose, vinyl resins, such as polyvinyl alcohol, polyvinyl acetate, polyvinyl butyral, polyvinyl acetal, and polyvinyl pyrrolidone, acrylic resins, such as polymethyl methacrylate, polyethyl acrylate, polyacrylamide, and acrylonitrile-styrene copolymer, polyamide resin, polyvinyltoluene resin, coumarone-indene resin, polyester resin, polyurethane resin, and silicone-modified or fluorine-modified urethane. These resins may be used either solely or as a mixture of two or more. In order to further enhance the heat resistance of the backside layer, preferably, among the above resins, a resin containing a reactive group based on a hydroxyl group is used in combination with polyisocyanate or the like as a crosslinking agent to form a crosslinked resin layer.

In order to impart slidability against the thermal head, a solid or liquid release agent or lubricant may be added to the backside layer to impart heat-resistant slipperiness to the backside layer. Release agents or lubricants include, for example, various waxes, such as polyethylene wax and paraffin wax, higher aliphatic alcohols, organopolysiloxanes, anionic surfactants, cationic surfactants, amphoteric surfactants, nonionic surfactants, fluorosurfactants, organic carboxylic acids and derivatives thereof, fluororesin, silicone resin, and fine particles of inorganic compounds such as talc, and silica. The content of the lubricant in the backside layer is about 5 to 50% by weight, preferably about 10 to 30% by weight.

The backside layer may be formed by dissolving or dispersing the above resin, optionally together with a release agent, a lubricant and the like, in a suitable solvent to prepare a coating liquid, coating the coating liquid by a conventional coating method, such as gravure coating, roll coating, or wire bar coating, and drying the coating. The coverage of the backside layer is about 0.1 to 10 g/m$^2$ on a dry basis.

(Peel-off Layer)

The thermal transfer sheet according to the present invention comprises a substrate and at least a peel-off layer 3 provided on the substrate. The peel-off layer is put on top of the intermediate transfer recording medium for the peel-off layer in the thermal transfer sheet to be brought into contact with the transfer part in the intermediate transfer recording medium, and the assembly is then heated to remove the transfer part in its predetermined region from the intermediate transfer recording medium.

The peel-off layer may be formed of any of conventional pressure-sensitive adhesives or heat-sensitive adhesives, preferably formed of a thermoplastic resin having a glass transition temperature (Tg) of 50° C. to 120° C. Preferably, for example, a resin having a suitable glass transition temperature is selected from resins having good thermal adhesion, such as vinyl chloride resins, vinyl chloride-vinyl acetate copolymer resins, acrylic resins, polyester resins, polyamide resins, styrene-acryl resins, styrene-vinyl chloride-vinyl acetate copolymers, butyral resins, epoxy resins, and polyamide resins.

The peel-off layer may be formed by adding optional additives, such as inorganic or organic fillers, to the resin for constituting the peel-off layer to prepare a coating liquid, coating the coating liquid by a conventional method, such as gravure coating, gravure reverse coating, or roll coating, and drying the coating. The thickness of the peel-off layer is preferably 0.1 to 5.0 g/m$^2$ on a dry basis. When the thickness of the peel-off layer is less than 0.1 g/m$^2$, the adhesion of the peel-off layer necessary for stripping off the transfer part in its predetermined region in the intermediate transfer recording medium is disadvantageously almost lost. Further, in some cases, the thermal transfer sheet is broken. When the thickness of the peel-off layer is above the upper limit of the above-defined thickness range, the heat sensitivity is unsatisfactory. This causes a deterioration in adhesion of the peel-off layer to the transfer part in the intermediate transfer recording medium, and, disadvantageously, a part of the region to be removed in the transfer part cannot be stripped off.

Figure 3:
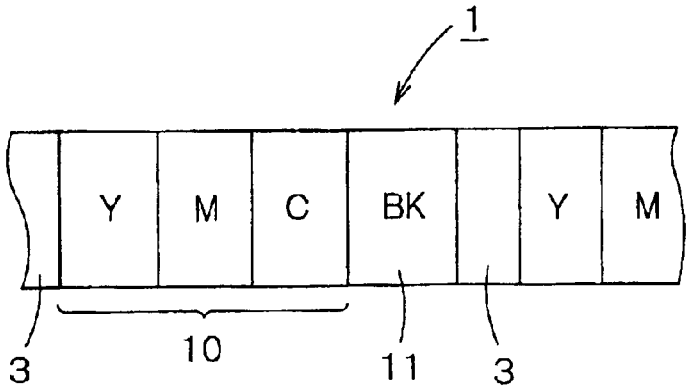
FIG. 3 is a schematic plan view showing another embodiment of the thermal transfer sheet according to the present invention.

FIG. 3 is a schematic plan view showing another embodiment of the thermal transfer sheet according to the present invention. In this embodiment, dye layers 10 of yellow (Y), magenta (M), and cyan (C), a heat-fusion layer 11 of black (BK), and a peel-off layer 3 are repeatedly provided by coating separately from one another on an identical surface of a substrate 2 in a face serial manner.

(Dye Layer)

The sublimable dye layer 10 is formed from a coating liquid containing a sublimable dye, a binder resin, and other optional ingredients. The sublimable dye, the binder resin and the like may be conventional ones and are not particularly limited. The dye layer maybe formed by a conventional method, for example, by preparing a coating liquid for a dye layer, coating the coating liquid onto a substrate film by means such as gravure printing and drying the coating.

The thickness of the dye layer is about 0.2 to 3 g/m$^2$ on a dry basis.

(Heat-fusion Layer)

The heat-fusion layer 11 may be formed using the same heat-fusion ink as used in the prior art. If necessary, various additives may be added to the heat-fusion ink. These materials may be conventional ones and are not particularly limited. The heat-fusion layer may be formed by coating the heat-fusion ink onto the substrate film by a coating method such as hot-melt coating. The thickness of the heat-fusion layer is determined from a relationship between necessary density and heat sensitivity and is generally preferably in the range of about 0.2 to 10 $\mu$m.

Figure 4:
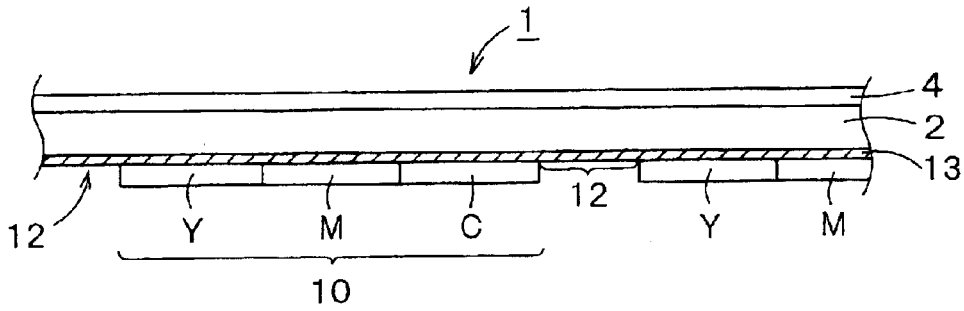
FIG. 4 is a schematic cross-sectional view showing still another embodiment of the thermal transfer sheet according to the present invention.

FIG. 4 is a schematic cross-sectional view showing still another embodiment of the thermal transfer sheet according to the present invention. In a thermal transfer sheet 1 in this embodiment, a backside layer 4 is provided on one side of a substrate 2, and the other side of the substrate 2 has been subjected to easy-adhesion treatment 13. Dye layers 10 of yellow (Y), magenta (M), and cyan (C), and an easy-adhesion treated surface exposed region 12 as a peel-off layer are repeatedly provided on the easy-adhesion treated 13 surface in a face serial manner.

(Easy-adhesion Treatment)

In the thermal transfer sheet, the surface of the substrate may be subjected to easy-adhesion treatment, or alternatively an easy-adhesion layer may be formed by coating on the surface of the substrate. The easy-adhesion treated surface of the substrate per se may be allowed to function as the peel-off layer.

The use of a plastic film, such as a polyester film, as the substrate in the thermal transfer sheet is disadvantageous in that, due to the chemical properties and the crystallization of the surface of the film, the cohesive force is so high that the adhesion of the substrate to the peel-off layer provided on the substrate is poor. To overcome this drawback, the surface of the plastic film may be subjected to easy-adhesion treatment by coextruding a low-crystalline polyester layer or the like onto the surface of the plastic film.

A primer layer may be provided on the substrate in the thermal transfer sheet by coating, for example, a mixture composition comprising a thermoplastic resin, various heat-curable resins, various curing agents, a reactive group-containing resin, or a coating composition which causes a crosslinking reaction upon exposure to light and an ionizing radiation. The coverage of the primer layer may be not more than 1.0 g/m$^2$, preferably 0.01 to 0.05 g/m$^2$, on a solid basis.

In the present invention, the easy-adhesion treatment 13 of the substrate refers to both the easy-adhesion treatment at the time of the manufacture of the substrate and the coating of the primer layer onto the substrate.

In the above substrate, for the thermal transfer sheet which has been subjected to easy-adhesion treatment, the easy-adhesion treated surface in its portion exposed on the surface of the substrate may be used as the peel-off layer without additionally providing any layer on the easy-adhesion treated surface of the substrate.

Figure 5:
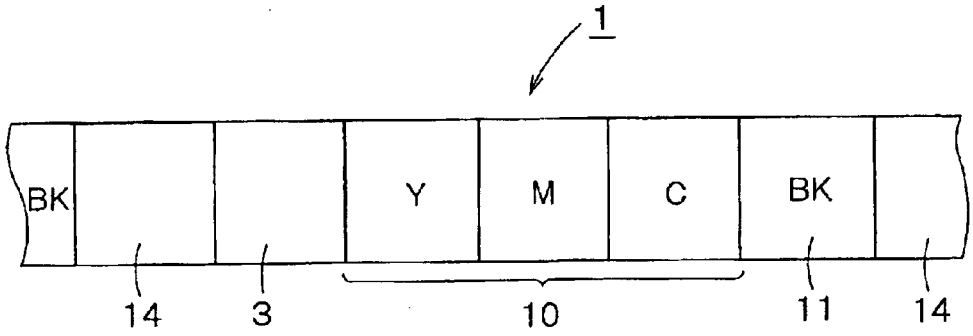
FIG. 5 is a schematic plan view showing a further embodiment of the thermal transfer sheet according to the present invention.

FIG. 5 is a schematic plan view showing a further embodiment of the thermal transfer sheet according to the present invention. In the thermal transfer sheet in this embodiment, a heating layer 14, a peel-off layer 3, dye layers 10 of yellow (Y), magenta (M), and cyan (C), and a heat-fusion layer 11 of black (BK) are repeatedly provided by coating separately from one another in a face serial manner on an identical surface of a substrate 2.

(Heating Layer)

This heating layer 14 is used for idle printing to heat the peripheral portion of a predetermined region, to be removed by the peel-off layer, in the transfer part in the intermediate transfer recording medium and thus to improve the adhesion between the heated part and the substrate film in the intermediate transfer recording medium. After the idle printing, the predetermined region in the transfer part of the intermediate transfer recording medium and the peel-off layer in the thermal transfer sheet can be heated together to completely remove the predetermined region in the transfer part with high accuracy.

The heating layer is covered with a material which is not adhered to the transfer part of the intermediate transfer recording medium, that is, may be formed of a material which is not adhered to the transfer part of the intermediate transfer recording medium. Specific examples of materials usable herein include resins, for example, polyvinyl acetal resins, polyvinyl butyral resins, phenoxy resins, CAB (cellulose acetate butyrate) resins, CAP (cellulose acetate propionate) resins, CA (cellulose acetate) resins, ethylcellulose resins, ethylhydroxyethylcellulose resins, polycarbonate resins, norbornene resins, acrylonitrile-styrene copolymer resins, phenylmaleimide resins, MMA (methyl methacrylate) resins, styrene resins, polyamide-imide resins, and polyvinyl formal resins. Release agents, such as silicone, fluoro, or phosphoric ester release agents, may be added to the above resin.

Further, in the thermal transfer sheet, when the substrate surface per se is not rendered adhesive upon heating, the heating layer may be an exposed portion of the substrate surface without providing any layer as the heating layer.

As described in the above embodiments of the thermal transfer sheet, in the thermal transfer sheet, only a peel-off layer may be provided as a full density blotted image. Alternatively, as shown in FIGS. 3 to 5, a peel-off layer, a dye layer and/or a heat-fusion layer, and a heating layer may be repeatedly provided in a face serial manner on an identical surface of the substrate in the thermal transfer sheet. In this case, the adoption of the embodiment, wherein the peel-off layer, the dye layer and/or the heat-fusion layer, and the heating layer are repeatedly provided in a face serial manner on an identical surface of the substrate in the thermal transfer sheet, is preferred because, the formation of a thermal transfer image on the intermediate transfer recording medium and the removal (stripping-off) of the transfer part in its predetermined region in the intermediate transfer recording medium by the peel-off layer can be carried out by controlling the carrying of one thermal transfer sheet. This can advantageously simplify the carrying system of the thermal transfer sheet in the method and apparatus for image formation. When the removing size can be limited, the pitch of the peel-off layer and the heating layer can be made smaller than the dye layer and the heat-fusion layer. This can reduce the necessary length of the thermal transfer sheet.

Next, the intermediate transfer recording medium used in the present invention will be described.

In the intermediate transfer recording medium, the substrate film 6 may be the same as that described above in connection with the thermal transfer sheet. At the time of heating of the assembly of the thermal transfer sheet and the intermediate transfer recording medium in such a state that the transfer part in the intermediate transfer recording medium and the peel-off layer in the thermal transfer sheet are put on top of each other, when heating is carried out from the backside of the intermediate transfer recording medium, a backside layer as described above in connection with the thermal transfer sheet may be provided on the surface of the substrate film in the intermediate transfer recording medium remote from the transfer part in the same manner as described above in connection with the provision of the backside layer in the thermal transfer sheet.

(Receptive Layer)

The receptive layer 6 is provided, as a part of the transfer part constituting the intermediate transfer recording medium, so as to be located at the outermost surface. An image is formed by thermal transfer on the receptive layer from a thermal transfer sheet having a colorant layer. The intermediate transfer recording medium in its transfer part with the image formed thereon is transferred onto an object, and, thus, a print is formed.

For this reason, a conventional resin material, which is receptive to a thermally transferable colorant such as a sublimable dye or a heat-fusion ink, may be used as the material for the formation of the receptive layer. Examples of materials usable herein include: polyolefin resins such as polypropylene; halogenated resins such as polyvinyl chloride or polyvinylidene chloride; vinyl resins such as polyvinyl acetate, vinyl chloride-vinyl acetate copolymer, ethylene-vinyl acetate copolymer, or polyacrylic ester; polyester resins such as polyethylene terephthalate or polybutylene terephthalate; polystyrene resins; polyamide resins; resins of copolymers of olefins, such as ethylene or propylene, with other vinyl polymers; ionomers; cellulosic resins such as cellulose diastase; and polycarbonates. Vinyl chloride resins, acryl-styrene resins, or polyester resins are particularly preferred.

When an enhancement in fixation of the transfer part onto an object is desired, the receptive layer is preferably formed of a resin material having adhesive properties, such as vinyl chloride-vinyl acetate copolymer.

The receptive layer may be formed by dissolving or dispersing a single or plurality of materials, selected from the above materials, optionally mixed with various additives or the like, in a suitable solvent such as water or an organic solvent to prepare a coating liquid for a receptive layer, coating the coating liquid by means such as gravure printing, screen printing, or reverse coating using a gravure plate, and drying the coating. The thickness of the receptive layer is about 1 to 10 g/m$^2$ on a dry basis.

(Peel-OP Layer)

In the intermediate transfer recording medium used in the present invention, the receptive layer may be provided on the substrate film through a peel-OP layer (peel-overprint layer or peel-protective layer). In this case, the transfer part in the intermediate transfer recording medium comprises the peel-OP layer and the receptive layer, and the peel-OP layer together with the receptive layer constituting the transfer part is transferred onto an object so that the peel-OP layer is located on the uppermost surface of the object. In other words, the peel-OP layer has both the function of protecting, as the layer located on the uppermost surface in the print, the thermally transferred image and the function of a peel layer at the time of the separation of the transfer part in its predetermined region in the intermediate transfer recording medium and at the time of the thermal transfer of the transfer part onto the object.

The peel-OP layer may be formed of, for example, waxes, such as microcrystalline wax, carnauba wax, paraffin wax, Fischer-Tropsh wax, various types of low-molecular weight polyethylene, Japan wax, beeswax, spermaceti, insect wax, wool wax, shellac wax, candelilla wax, petrolactum, partially modified wax, fatty esters, and fatty amides, and thermoplastic resins, such as silicone wax, silicone resin, fluororesin, acrylic resin, polyester resin, polyurethane resin, cellulose resin, vinyl chloride-vinyl acetate copolymer, and nitrocellulose.

Particularly preferably, the peel-OP layer is composed mainly of a resin possessing excellent transparency, abrasion resistance, chemical resistance and other properties, such as an acrylic resin, a polyester resin, or a polyurethane resin. The above wax may be optionally added to this resin.

The peel-OP layer may be formed by coating the resin by conventional means, such as hot-melt coating, hot lacquer coating, gravure coating, gravure reverse coating, or roll coating, and drying the coating. The thickness of the peel-OP layer is preferably about 0.1 to 5 g/m$^2$ on a dry basis.

Even when the transfer part does not include the peel-OP layer, suitable adhesion between the receptive layer and the substrate film can be imparted by rendering the receptive layer and the substrate film separable from each other. Further, the same separability as the peel-OP layer can be imparted by imparting separability to the substrate film per se.

Instead of the peel-OP layer, a release layer may be provided on the substrate film. The release layer may generally comprise a binder resin and a releasable material. The release layer is hardly separated from the substrate film at the time of thermal transfer and stays on the substrate film side.

Binder resins usable for the release layer include thermoplastic resins, for example, acrylic resins, such as polymethyl methacrylate, polyethyl methacrylate, and polybutyl acrylate, vinyl resins, such as polyvinyl acetate, vinyl chloride-vinyl acetate copolymer, polyvinyl alcohol, and polyvinylbutyral, and cellulose derivatives, such as ethylcellulose, nitrocellulose, and cellulose acetate, and thermosetting resins, for example, unsaturated polyester resins, polyester resins, polyurethane resins, and aminoalkyd resins. Releasable materials include waxes, silicone wax, silicone resins, melamine resins, fluororesins, fine powders of talc or silica, and lubricants such as surfactants or metal soaps.

The release layer may be formed by dissolving or dispersing the above resin in a suitable solvent to prepare a coating liquid for a release layer, coating the coating liquid onto a substrate film by gravure printing, screen printing, reverse coating using a gravure plate or other means, and drying the coating. The thickness of the release layer is generally 0.1 to 10 g/m$^2$ on a dry basis.

(Object)

Next, the object 15 will be described. The intermediate transfer recording medium in its transfer part with a thermal transfer image formed thereon is transferred onto the object.

The object used in the present invention is not particularly limited, and examples thereof include natural pulp paper, coated paper, tracing paper, plastic films which are not deformed upon exposure to heat at the time of transfer, glasses, metals, ceramics, wood, and cloths.

In this case, when a masking layer is used in the object and when the object in its region, on which the transfer part in the intermediate transfer recording medium is not to be transferred, is, for example, a writing space, for example, for address and name, or a sealing space for a person who makes an entry in the space or an issuer, the use of a natural pulp paper, which has no need to provide any special layer on its surface and has suitability for writing and sealing, as an object is preferred.

The natural pulp paper is not particularly limited, and examples thereof include wood free paper, art paper, lightweight coated paper, ultra lightweight coated paper, coated paper, cast coated paper, synthetic resin- or emulsion-impregnated paper, synthetic rubber latex-impregnated paper, paper with synthetic resin internally added thereto, and thermal transfer paper.

The form and applications of the object are also not limited, and examples thereof include: gold notes, such as stock certificates, securities, deeds, passbooks, railway tickets, streetcar tickets, stamps, postage stamps, appreciation tickets, admission tickets, and other tickets; cards, such as bank cards, credit cards, prepaid cards, membership cards, greeting cards, postcards, business cards, driver's licenses, IC cards, and optical cards; cases, such as cartons and containers; bags; forms control; envelops; tags; OHP sheets; slide films; bookmarks; calendars; posters; pamphlets; menus; POP goods; coasters; displays; name plates; keyboards; cosmetics; accessories such as wristwatches and lighters; stationeries such as report pads; passports, small books, magazines, and other booklets; building materials; panels; emblems; keys; cloths; clothes; footwears; equipment or devices such as radios, televisions, electronic calculators, and OA equipment; various sample or pattern books; albums; and outputs of computer graphics and outputs of medical images.

Ancillary products, such as an IC chip, a signature part, a sealing part, and a holo-CI mark part, are preferably provided on the surface of the object to add values to the object. The covering of the ancillary product with the transfer part (receptive layer) from the intermediate transfer recording medium is unfavorable because the presence of the transferred material even in a small amount on the ancillary product hinders the function of the ancillary product.

(Method for Image Formation and Method for Image-formed Object Formation)

The method for image formation and the method for image-formed object formation according to the present invention will be described. In the method for image formation and the method for image-formed object formation, the above thermal transfer sheet and the above intermediate transfer recording medium are first provided. The thermal transfer sheet and the intermediate transfer recording medium are put on top of each other so that the peel-off layer in the thermal transfer sheet is brought into contact with the transfer part in the intermediate transfer recording medium. The assembly is heated to remove the transfer part in its predetermined region from the intermediate transfer recording medium, and the transfer part in the intermediate transfer recording medium is then retransferred onto an object.

Figure 6:
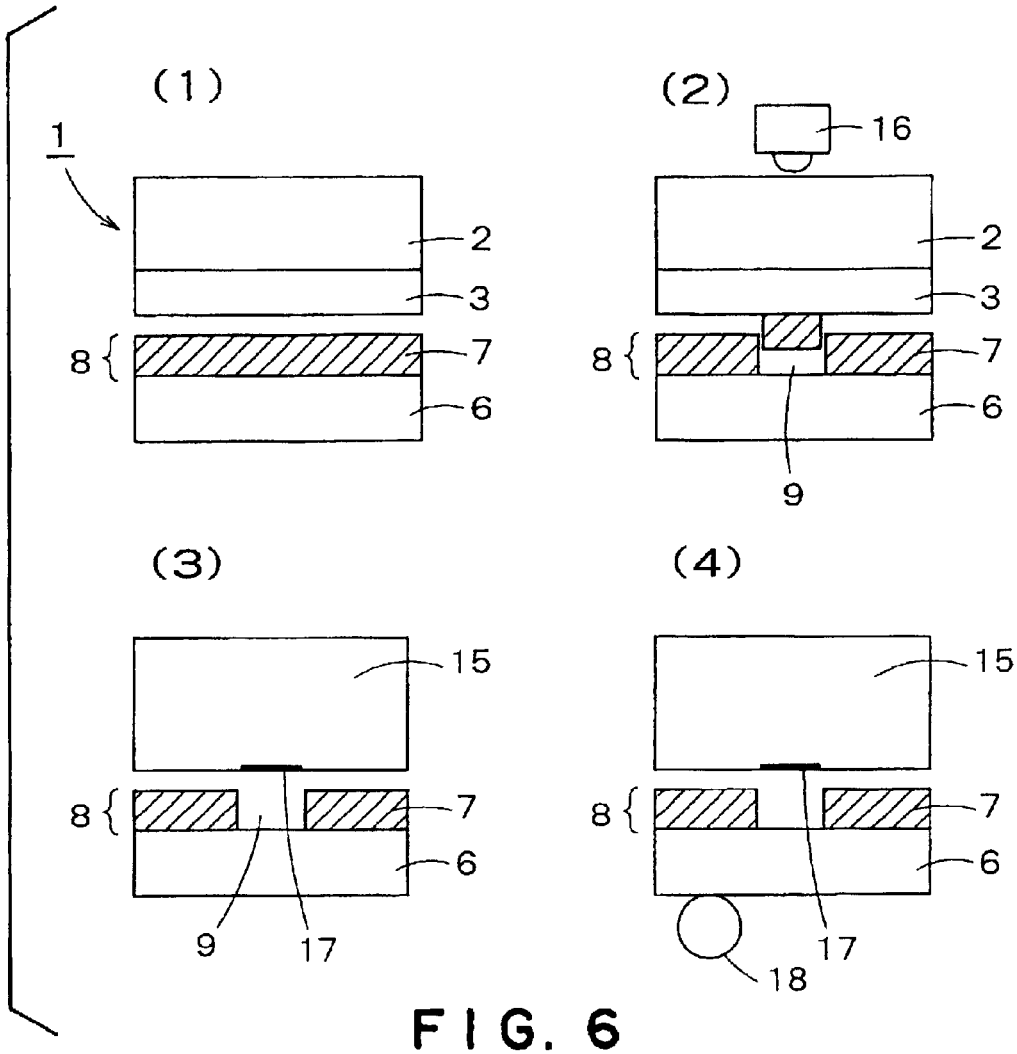
FIG. 6 is a schematic diagram illustrating an embodiment of the method for image formation and the method for an image-formed object formation according to the present invention.

FIG. 6 is a schematic diagram illustrating an embodiment of the method for image formation and the method for image-formed object formation according to the present invention. As shown in FIG. 6 (1), a thermal transfer sheet 1 comprising a substrate 2 and a peel-off layer 3 provided on the substrate 2 is provided. Further, an intermediate transfer recording medium 5 comprising a substrate film 6 and a transfer part 8, comprising a receptive layer 7, provided separably on the substrate film 6 is provided. In this case, a thermal dye transfer image and/or a thermal ink transfer image may be previously formed on the transfer part 8 of the intermediate transfer recording medium 5.

Next, as shown in FIG. 6 (2), the thermal transfer sheet 1 and the intermediate transfer recording medium 5 are put on top of each other so that the peel-off layer 3 in the thermal transfer sheet 1 is brought into contact with the transfer part 8 in the intermediate transfer recording medium 5. The assembly is heated by heating means of a thermal head 16 to remove the transfer part in its predetermined region 9 from the intermediate transfer recording medium 5. In this case, the removed portion is transferred onto the peel-off layer 3 side in the thermal transfer sheet 1.

Next, as shown in FIG. 6 (3), the intermediate transfer recording medium 5 after the removal of the predetermined region 9 from the transfer part 8 and an object 15 are put on top of each other so that the transfer part 8 in the intermediate transfer recording medium 5 is brought into contact with the image forming face of the object 15. The object 15 is provided with an ancillary product 17, and the removal predetermined region 9 in the transfer part 8 of the intermediate transfer recording medium 5 is registered with the object 15 in its region where the ancillary product 17 has been provided. The step of forming a thermal dye transfer image and/or a thermal ink transfer image on the transfer part of the intermediate transfer recording medium may be carried out between the step shown in FIG. 6 (2) and the step shown in FIG. 6 (3).

Next, as shown in FIG. 6 (4), the transfer part B with a thermal transfer image formed thereon in the intermediate transfer recording medium 5 is retransferred onto the object by heating means of a heat roll 18. At the time of the retransfer, the transfer part 8 is not transferred onto the ancillary product 17 provided in the object 15.

The heating means used for image formation by the thermal transfer and the heating means used for heating of the peel-off layer and the transfer part are not limited to the thermal head. For example, heating means using a light source or a laser beam source may be used. The heating means used for retransferring the transfer part with a thermal transfer image formed thereon onto an object is not limited to a heat roll method, and, for example, a hot stamping method and a thermal head method may also be used.

In the present invention, before the removal of the transfer part in its predetermined region from the intermediate transfer recording medium, the peripheral portion of the predetermined region in the transfer part may be heated by idle printing of a heating layer (not shown in FIG. 6) covered with a material which is not adhered to the transfer part. In this idle printing, the thermal transfer sheet is put on top of the intermediate transfer recording medium so that the heating layer in the thermal transfer sheet is brought into contact with the transfer part in the intermediate transfer recording medium. The assembly is heated by heating means such as a thermal head. In this idle printing, any transfer does not take place. Therefore, an image is not printed. The idle printing improves the adhesion between the substrate film and the transfer part in the intermediate transfer recording medium, and, upon subsequent heating of the transfer part and the peel-off layer, the transfer part can be removed, from the intermediate transfer recording medium, in a shape which conforms faithfully to the heated region.

When a thermal transfer sheet comprising the peel-off layer, the dye layer and/or heat-fusion layer, and the heating layer provided by coating separately from one other on an identical surface of a substrate film is used, preferably, detection marks commonly used in the art for the detection of position in each step are provided to accurately carry out registration, for example, at the time of the thermal transfer of a thermal transfer image and at the time of the transfer of the transfer part in its predetermined region in the intermediate transfer recording medium onto the peel-off layer. The detection marks are detected by a detector, and each registration is carried out in interlocking with a printing apparatus.

When a thermal transfer sheet having the above-peel-off layer (a peel-off ribbon) is used, for some printing apparatus, unfavorable phenomena sometimes occur including that, at the time of the removal of the nontransfer region from the intermediate transfer recording medium, the ribbon is broken, or the nontransfer region is not fully removed in a shape conforming faithfully to the heated region resulting in the stay of a part of the nontransfer region in the transfer part, or, in removing the nontransfer region, the boundary between the nontransfer region and the transfer region is brought to a serrated state without being sharply cut.

To eliminate the above problem, in a preferred embodiment of the present invention, the following method is preferably adopted. In the use of the thermal transfer sheet, the thermal transfer sheet and the intermediate transfer recording medium are put on top of each other so that the peel-off layer in the thermal transfer sheet is brought into contact with the transfer part in the intermediate transfer recording medium. The assembly is then heated, and, within 0.8 sec after the start of the heating, the peel-off layer is separated from the intermediate transfer recording medium.

More preferably, the separation of the peel-off layer from the intermediate transfer recording medium is carried out at a peel angle of less than 90 degrees.

"Flash" or unfaithful transfer is one of unfavorable phenomena caused in image formation by the prior art technique. For example, this phenomenon occurs at the end face of a card when the transfer part is retransferred onto the card. In this case, the transfer part adhered to the end face of the card as such emerges from the printer, or otherwise comes off from the end face of the card within the printer. This is causative of a deterioration in quality of the print.

Both a material and a printer mechanism may be mentioned as causes of the flash. Regarding the material, the incorporation of an additive can sometimes reduce flash. This, however, sometimes causes a different problem. Therefore, an additive, which does not cause the different problem, should be carefully selected. Regarding the printer mechanism, the size of flash and the position of flash vary depending upon retransfer temperature, retransfer speed, peel angle, peeling position and the like.

Accordingly, in a preferred embodiment of the present invention, in order to eliminate the above drawback, the step of previously removing a portion, which is likely to cause flash after the retransfer, by the peel-off layer is provided.

Figure 7:
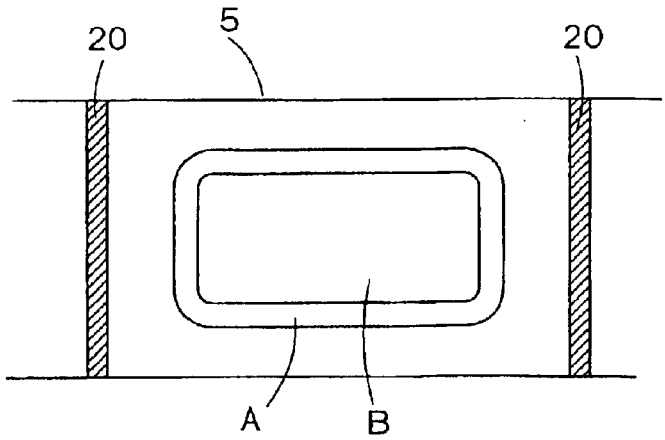
FIG. 7 is a plan view of an intermediate transfer recording medium used in one embodiment of the method for image formation according to the present invention.

FIG. 7 is a plan view illustrating the state of an intermediate transfer recording medium 5 in carrying out this embodiment. In this embodiment, in the intermediate transfer recording medium 5, which has been registered by the detection marks 20, a transfer region A and a transfer region B are determined. The region A, which is expected to cause flash, is previously removed by the peel-off layer. The region A may be properly selected by means suitable for the elimination of flash depending upon the object used. For example, the problem of "flash" can be solved by previously separating and removing a portion of the surface of the intermediate transfer recording medium, which is likely to cause flash (this portion may be the whole peripheral portion of a primary transferred image or only a region where flash is likely to occur), using a peel-off ribbon and then retransferring the transfer part.

EXAMPLES

Example 1

A 12 $\mu$m-thick transparent polyethylene terephthalate film was first provided as a substrate film. The following coating liquid for a peel-OP layer was coated onto the surface of the substrate film, and the coating was dried to form a peel-OP layer having a thickness of 2.0 g/m$^2$ on a dry basis on the substrate film. In this case, a backside layer was previously formed to a thickness of 1.0 g/m$^2$ on a dry basis on the substrate film.

(Coating Liquid for Peel-OP Layer)

| | |
|---|---|
| Acrylic resin (BR-83, manufactured by Mitsubishi Rayon Co., Ltd.) | 88 parts |
| Polyester resin | 1 part |
| Polyethylene wax | 11 parts |
| Methyl ethyl ketone | 50 parts |
| Toluene | 50 parts |

Next, the following coating liquid for a receptive layer was coated on the peel-OP layer, and the coating was dried to form a receptive layer having a thickness of 2.0 g/m$^2$ on a dry basis. Thus, an intermediate transfer recording medium was provided.

(Coating Liquid for Receptive Layer)

| | |
|---|---|
| Vinyl chloride-vinyl acetate copolymer | 40 parts |
| Acrylsilicone | 1.5 parts |
| Methyl ethyl ketone | 50 parts |
| Toluene | 50 parts |

A 6 $\mu$m-thick polyethylene terephthalate film was provided as a substrate. As shown in FIG. 3, dye layers of yellow, magenta, and cyan, a heat-fusion layer, which is thermofusibly transferable and has black hue, and a peel-off layer having the following composition were repeatedly formed in a face serial manner to prepare a thermal transfer sheet of Example 1. The thickness of the peel-off layer was 0.5 g/m$^2$ on a dry basis.

A backside layer was previously formed to a thickness of 1.0 g/m$^2$ on a dry basis on the substrate.

(Peel-off Layer)

| | |
|---|---|
| Acrylic resin (BR-87, manufactured by Mitsubishi Rayon Co., Ltd.) | 5 parts |
| Methyl ethyl ketone | 47.5 parts |
| Toluene | 47.5 parts |

Example 2

A thermal transfer sheet of Example 2 was prepared in the same manner as in Example 1, except that the thickness of the peel-off layer in the thermal transfer sheet prepared in Example 1 was changed to 0.3 g/m$^2$ on a dry basis.

Example 3

A thermal transfer sheet of Example 3 was prepared in the same manner as in Example 1, except that the thickness of the peel-off layer in the thermal transfer sheet prepared in Example 1 was changed to 1.0 g/m$^2$ on a dry basis.

Example 4

A thermal transfer sheet of Example 4 was prepared in the same manner as in Example 1, except that the thickness of the peel-off layer in the thermal transfer sheet prepared in Example 1 was changed to 2.0 g/m$^2$ on a dry basis.

Comparative Example 1

A thermal transfer sheet of Comparative Example 1 was prepared in the same manner as in Example 1, except that the thickness of the peel-off layer in the thermal transfer sheet prepared in Example 1 was changed to 0.05 g/m$^2$ on a dry basis.

Comparative Example 2

A thermal transfer sheet of Comparative Example 2 was prepared in the same manner as in Example 1, except that the thickness of the peel-off layer in the thermal transfer sheet prepared in Example 1 was changed to 5.5 g/m$^2$ on a dry basis.

Example 5

A thermal transfer sheet of Example 5 was prepared in the same manner as in Example 1, except that the composition of the ink of the peel-off layer in the thermal transfer sheet prepared in Example 1 was changed to the following composition.

(Peel-off Layer)

| | |
|---|---|
| Vinyl chloride-vinyl acetate copolymer resin (SOLBIN A, manufactured by Nissin Chemical Industry Co., Ltd.) | 5 parts |
| Methyl ethyl ketone | 47.5 parts |
| Toluene | 47.5 parts |

Example 6

A thermal transfer sheet of Example 6 was prepared in the same manner as in Example 1, except that the composition of the ink of the peel-off layer in the thermal transfer sheet prepared in Example 1 was changed to the following composition.

(Peel-off Layer)

| | |
|---|---|
| Vinyl chloride-vinyl acetate copolymer resin (SOLBIN CL, manufactured by Nissin Chemical Industry Co., Ltd.) | 5 parts |
| Methyl ethyl ketone | 47.5 parts |
| Toluene | 47.5 parts |

Example 7

A thermal transfer sheet of Example 7 was prepared in the same manner as in Example 1, except that the composition of the ink of the peel-off layer in the thermal transfer sheet prepared in Example 1 was changed to the following composition.

(Peel-off Layer)

| | |
|---|---|
| Polyester resin (Vylon 700, manufactured by Toyobo Co., Ltd.) | 5 parts |
| Methyl ethyl ketone | 47.5 parts |
| Toluene | 47.5 parts |

Example 8

A thermal transfer sheet of Example 8 was prepared in the same manner as in Example 1, except that the composition of the ink of the peel-off layer in the thermal transfer sheet prepared in Example 1 was changed to the following composition.

(Peel-off Layer)

| | |
|---|---|
| Acrylic resin (BR-87, manufactured by Mitsubishi Rayon Co., Ltd.) | 5 parts |
| Polyethylene powder (MF 8 F, manufactured by ASTORWAX Co.) | 0.15 part |
| Methyl ethyl ketone | 47.5 parts |
| Toluene | 47.5 parts |

Example 9

A 6 $\mu$m-thick easy-adhesion treated polyethylene terephthalate film (K 203 E, manufactured by MITSUBISHI POLYESTER FILM CORPORATION) was provided as a substrate. A thermal transfer sheet of Example 9 was prepared wherein dye layers of yellow, magenta, and cyan, a heat-fusion layer, which is thermofusibly transferable and has black hue, and a part having an easy-adhesion treated face exposed region were repeatedly formed in a face serial manner. The easy-adhesion treated face exposed region was the easy-adhesion face per se of the substrate, and any layer was not provided on that. The easy-adhesion treated face exposed region corresponds to a peel-off layer.

A backside layer having a thickness of 1.0 g/m$^2$ on a dry basis was previously formed on the surface of the substrate remote from the easy-adhesion treated surface in the same manner as in Example 1.

Example 10

A 6 $\mu$m-thick polyethylene terephthalate film was provided as a substrate. As shown in FIG. 5, a heating layer, a peel-off layer, dye layers of yellow, magenta, and cyan, and a heat-fusion layer, which is thermofusibly transferable and has black hue, were repeatedly provided in a face serial manner to prepare a thermal transfer sheet. The heating layer was the substrate per se in its exposed surface portion. The dye layers of yellow, magenta, and cyan and the heat-fusion transferable black layer were prepared in the same manner as in Example 1, and the peel-off layer was provided in the same manner as in Comparative Example 2.

A backside layer having a thickness of 1.0 g/m$^2$ on a dry basis was previously formed on the substrate in the same manner as in Example 1.

Example 11

A 6 $\mu$m-thick easy-adhesion treated polyethylene terephthalate film (K 203 E, manufactured by MITSUBISHI POLYESTER FILM CORPORATION) was provided as a substrate. A heating layer, formed from the following composition, a peel-off layer as a part having an easy-adhesion treated face exposed region, dye layers of yellow, magenta, and cyan, and a heat-fusion layer, which is thermofusibly transferable and has black hue were repeatedly formed in a face serial manner to prepare a thermal transfer sheet of Example 11. The easy-adhesion treated face exposed region was the easy-adhesion face per se of the substrate, and any layer was not provided on that. The easy-adhesion treated face exposed region corresponds to a peel-off layer.

A backside layer having a thickness of 1.0 g/m$^2$ on a dry basis was previously formed on the surface of the substrate remote from the easy-adhesion treated surface in the same manner as in Example 1.

(Heating Layer)

| | |
|---|---|
| Polyvinyl acetal resin (KS-5, manufactured by Sekisui Chemical Co., Ltd.) | 5 parts |
| Methyl ethyl ketone | 47.5 parts |
| Toluene | 47.5 parts |

Thermal transfer sheets of the examples and the comparative examples and the intermediate transfer recording medium prepared as described in Example 1 were provided. The thermal transfer sheet was put on top of the receptive layer in the intermediate transfer recording medium. A thermal dye transfer photograph-like image and a thermal ink transfer character image were formed by thermal transfer with a thermal transfer printer loaded with a commercially available thermal head.

Next, the intermediate transfer recording medium was put on top of the thermal transfer sheet so that the receptive layer with images formed thereon in the intermediate transfer recording medium was brought into contact with the peel-off layer in the thermal transfer sheet. The transfer part of the receptive layer was stripped off in a position and a pattern corresponding to a handwriting space (signature space) for address and name from the intermediate transfer recording medium by means of the above thermal transfer printer.

Thereafter, the transfer part with images formed there on was retransferred on a designated position of a 600 $\mu$m-thick white PET-G sheet (PET-G, DIAFIX PG-W, manufactured by Mitsubishi Plastic Industries Ltd.) by means of a commercially available laminator with a stationary heat roll to provide an image-formed object. In the PET-G sheet, the transfer face in its position corresponding to the handwriting space for address and name was previously subjected to sign panel treatment.

For the image-formed objects prepared in Examples 1 to 9, since a predetermined region of the transfer part in the intermediate transfer recording medium had been removed by the peel-off layer, any layer was not transferred on the handwriting space (signature space) in the card. Therefore, handwriting could successfully be carried out without any problem.

For Comparative Example 1, the intermediate transfer recording medium was put on top of the thermal transfer sheet so that the receptive layer with images formed thereon in the intermediate transfer recording medium was brought into contact with the peel-off layer in the thermal transfer sheet. Thereafter, an attempt has been made to strip off the transfer part of the receptive layer from the intermediate transfer recording medium. However, the receptive layer could not be stripped off.

For Comparative Example 2, since the peel-off layer of the thermal transfer sheet had low adhesion to the transfer part of the intermediate transfer recording medium, a part to be stripped off in the transfer part remained unremoved. Further, the edge of the stripped-off portion was not sharp, and the edge part, which should be linear after stripping-off, was in a serrated form. That is, burrs were formed at the edge part.

For Examples 10 and 11, the thermal transfer sheet and the intermediate transfer recording medium prepared as described in Example 1 were first provided. A thermal dye transfer photograph-like image and a thermal ink transfer character image were formed by thermal transfer on the receptive layer in the intermediate transfer recording medium by means of a thermal transfer printer loaded with a commercially available thermal head for hot separation. Next, the periphery of the transfer part region, which is the position corresponding to a handwriting space (signature space) of a card as an object, was heated by idle printing utilizing the heating layer by means of the above thermal transfer printer. Next, each of the thermal transfer sheet and the intermediate transfer recording medium were put on top of each other so that the peel-off layer in the thermal transfer sheet was brought into contact with the transfer part with images formed thereon in the intermediate transfer recording medium, followed by heating with the same thermal transfer printer to remove the transfer part in its predetermined region (region corresponding to the handwriting space for address and name in the card) from the intermediate transfer recording medium. Thereafter, in the same manner as in Examples 1 to 9, the transfer part with images formed thereon in the intermediate transfer recording medium was retransferred on a designated position of a PET-G sheet by means of a commercially available laminator with a stationary heat roll to provide an image-formed object. In the PET-G sheet, the transfer face in its position corresponding to the handwriting space for address and name was previously subjected to sign panel treatment.

For the image-formed objects prepared in Examples 10 and 11, since a predetermined region of the transfer part in the intermediate transfer recording medium had been removed by the peel-off layer, any layer was not transferred onto the handwriting space (signature space) in the card. Therefore, handwriting could successfully be carried out without any problem.

For Example 10, particularly unlike Comparative Example 2, any burr was not formed at the outer edge of the handwriting space (signature space), and the edge was linear and sharp.

Examples 12 to 18 and Comparative Examples 3 to 6

A backside layer was formed on one side of a 6 $\mu$m-thick PET in the same manner as in Example 1.

The following composition was coated at a coverage of 0.5 g/m$^2$ on a dry basis on the surface of the PET remote from the backside layer to prepare a peel-off ribbon.

| | |
|---|---|
| Acrylic resin (BR-87, manufactured by Mitsubishi Rayon Co., Ltd.) | 5 parts |
| Toluene | 47.5 parts |
| Methyl ethyl ketone | 47.5 parts |

Separately, a receptive layer was formed on one side of a 16 $\mu$m-thick. PET in the same manner as in Example 1 to prepare an intermediate transfer recording medium.

The peel-off ribbon was allowed to face the intermediate transfer recording medium. The assembly was heated from the backside of the peel-off ribbon by means of a 300-dpi thermal head. The nontransfer region was then removed from the intermediate transfer recording medium under the following conditions.

The peel time was calculated based on the printing speed and the peel distance.

TABLE 1

| | Printing speed | Time from printing to peeling | Peel angle | Breaking of ribbon | Transfer region |
|---|---|---|---|---|---|
| Ex. 12 | 1.5 ms/dot | 0.018 s | 90° | ○ | ○ |
| Ex. 13 | 3.0 ms/dot | 0.153 s | 90° | ○ | ○ |
| Ex. 14 | 5.0 ms/dot | 0.510 s | 90° | ○ | ○ |
| Ex. 15 | 7.6 ms/dot | 0.780 s | 90° | ○ | ○ |
| Comp. Ex. 3 | 5.0 ms/dot | 0.900 s | 90° | ○ | X |
| Comp. Ex. 4 | 5.0 ms/dot | 1.200 s | 90° | X | X |

Breaking of ribbon) ○: no problem occurred, X: ribbon was broken
Transfer region) ○: no problem occurred, X: serrated or unremoved region appeared at the boundary between the transfer region and the non-transfer region.

Further, in the same manner as described above, the intermediate transfer recording medium and the peel-off ribbon were fused to each other by means of a 300-dpi thermal head. The assembly was allowed to stand for a given time, and the nontransfer region in the intermediate transfer recording medium was then removed at the following peel angle.

TABLE 2

| | Peel angle | Breaking of ribbon | Transfer region |
|---|---|---|---|
| Ex. 16 | 20° | ○ | ○ |
| Ex. 17 | 40° | ○ | ○ |
| Ex. 18 | 80° | ○ | ○ |
| Comp. Ex. 5 | 100° | ○ | X |
| Comp. Ex. 6 | 120° | X | X |

Breaking of ribbon) ○: no problem occurred, X: ribbon was broken
Transfer region) ○: no problem occurred, X: serrated or unremoved region appeared at the boundary between the transfer region and the non-transfer region.

Example 19

The thermal transfer sheets provided with a peel-off layer and the intermediate transfer recording medium used in the above examples were provided, and a thermal transfer image was formed by means of a thermal transfer printer on the receptive layer of the intermediate transfer recording medium.

Next, the intermediate transfer recording medium and the thermal transfer sheet were put on top of each other so that the receptive layer with a thermal transfer image formed thereon in the intermediate transfer recording medium was brought into contact with the peel-off layer in the thermal transfer sheet, followed by stripping-off of a transfer part (A) including at least a part of the receptive layer in such a manner that the stripped-off part (A) and the transfer part (B) surrounded by the stripped-off part (A) are in registration with the peripheral portion and the sign panel of a card (PET-G card, vinyl chloride card) as an object, respectively (FIG. 7).

Next, the transfer part (B) (FIG. 7) with an image formed thereon was transferred by means of a heat roll onto the card to prepare an image-formed object.

Since the transfer part in its predetermined region (A) in the intermediate transfer recording medium had been removed by the peel-off layer, the occurrence of "flash" was not observed at the end face of the card as the image-formed object.

On the other hand, when the position corresponding to the peripheral portion of the card had not been removed, the occurrence of flash was observed at the end face of the card as the image-formed object.

As described above, in the method for image formation according to the present invention, a thermal transfer sheet comprising a substrate and at least a peel-off layer provided on the substrate is provided. Further, an intermediate transfer recording medium comprising a substrate film and a transfer part, comprising at least a receptive layer, provided separably on the substrate film is provided. The thermal transfer sheet and the intermediate transfer recording medium are put on top of each other so that the peel-off layer in the thermal transfer sheet is brought into contact with the transfer part in the intermediate transfer recording medium. The assembly is heated to remove the transfer part in its predetermined region from the intermediate transfer recording medium. The transfer part is then retransferred from the intermediate transfer recording medium onto an object.

Specifically, a predetermined region of the transfer part in the intermediate transfer recording medium is put on top of the peel-off layer in the thermal transfer sheet, and the assembly is heated to transfer the transfer part in its predetermined region onto the thermal transfer sheet side provided with the peel-off layer, that is, to separate the transfer part in its predetermined region from the intermediate transfer recording medium side. The transfer part in the intermediate transfer recording medium is then retransferred onto an object in such a state that the removed (separated) region in the transfer part of the intermediate transfer recording medium is in registration with the object in its nontransfer region, that is, in its region where an IC chip, a signature space or the like has been provided and, the transfer of the transfer part from the intermediate transfer recording medium poses a problem.

By virtue of the removal of the transfer part in its predetermined region in the intermediate transfer recording medium by utilizing the peel-off layer before the transfer of the transfer part onto an object, the transfer of the transfer part onto the nontransfer region, such as an IC chip or a signature space, in the object can be surely prevented, and, thus, the function of the IC chip, the signature space and the like is not deteriorated.

Further, according to the method for image formation according to the present invention, a nontransfer region as a predetermined region for an IC chip, a signature space or the like can be simply formed on an object by using a thermal transfer sheet comprising at least a peel-off layer provided on a substrate without using any special mechanism or method, such as a sticking-and-removing mechanism, for removing an unnecessary part in the transfer part adhered to the object.

Preferably, before the removal of the transfer part in its predetermined region (a part corresponding to a region, in an object, where an IC chip or a signature space, a holo-CI mark or the like has been provided) from the intermediate transfer recording medium, the peripheral portion of the predetermined region is heated by idle printing using a heating layer covered with a material which is not adhered to the transfer part. The idle printing can improve the adhesion between the substrate film and the transfer part in the intermediate transfer recording medium, and, upon heating of the transfer part and the peel-off layer, the transfer part in its predetermined region can be accurately and completely removed. In other words, the transfer part can onto the object with good transferability.

What is claimed is:

1. A thermal transfer sheet adapted for the formation of a thermal dye transfer image and/or a thermal ink transfer image on a transfer part in an intermediate transfer recording medium, said intermediate transfer recording medium comprising a substrate film and a transfer part, comprising at least a receptive layer, provided separably on the substrate film, said thermal transfer sheet being also adapted for use before the retransfer of the transfer part in the intermediate transfer recording medium onto an object, said thermal transfer sheet comprising a substrate and at least a peel-off layer provided on the substrate, said thermal transfer sheet being configured so that the transfer part in its predetermined region can be removed from the intermediate transfer recording medium by putting the thermal transfer and the intermediate transfer recording medium on top of each other so that the peel-off layer in the thermal transfer sheet is brought into contact with the transfer part in the intermediate transfer recording medium and then heating the assembly.

2. The thermal transfer sheet according to claim 1, wherein the peel-off layer is provided by coating separately from a dye layer for the formation of a thermal dye transfer image and/or a heat-fusion layer for the formation of a thermal ink transfer image on an identical surface of the substrate.

3. The thermal transfer sheet according to claim 1, wherein the substrate in the thermal transfer sheet has been subjected to easy-adhesion treatment and the peel-off layer is an exposed region of the easy-adhesion treated surface.

4. The thermal transfer sheet according to claim 2, wherein a heating layer covered with a material, which is not adhered to the transfer part in the intermediate transfer recording medium, for heating the peripheral portion of the predetermined region is provided by coating separately from the peel-off layer, the dye layer and/or the heat-fusion layer on an identical surface of the substrate.

5. A method for image formation, comprising the steps of:

providing a thermal transfer sheet comprising a substrate and at least a peel-off layer provided on the substrate, and an intermediate transfer recording medium comprising a substrate film and a transfer part, comprising at least a receptive layer, separably provided on the substrate film;

putting the thermal transfer sheet and the intermediate transfer recording medium on top of each other so that the peel-off layer in the thermal transfer sheet is brought into contact with the transfer part in the intermediate transfer recording medium;

heating the assembly to remove the transfer part in its predetermined region from the intermediate transfer recording medium; and then retransferring the transfer part in the intermediate transfer recording medium onto an object.

6. The method for image formation according to claim 5, wherein, after or before the formation of the thermal dye transfer image and/or a thermal ink transfer image on any position of the transfer part in the intermediate transfer recording medium, the thermal transfer sheet and the intermediate transfer recording medium are put on top of each other so as for the peel-off layer in the thermal transfer sheet to be brought into contact with the transfer part in the intermediate transfer recording medium, the assembly is heated to remove the transfer part in its predetermined region from the intermediate transfer recording medium, and the predetermined thermal transfer image region in the transfer part in the intermediate transfer recording medium is transferred onto the object to form an image on the object.

7. The method for image formation according to claim 5, wherein, before the removal of the transfer part in its predetermined region from the intermediate transfer recording medium, the peripheral portion of the predetermined region in the transfer part is heated by idle printing of a heating layer covered with a material which is not adhered to the transfer part.

8. A method for image-formed object formation, comprising the steps of:

first providing an ancillary product or part on an object;

providing a thermal transfer sheet comprising a substrate and at least a peel-off layer provided on the substrate, and an intermediate transfer recording medium comprising a substrate film and a transfer part, comprising at least a receptive layer, separably provided on the substrate film;

after or before the formation of a thermal dye transfer image and/or a thermal ink transfer image on any position of the transfer part in the intermediate transfer recording medium, putting the thermal transfer sheet and the intermediate transfer recording medium on top of each other so that the peel-off layer in the thermal transfer sheet is brought into contact with the transfer part in the intermediate transfer part in its predetermined region from the intermediate transfer recording medium;

registering the removed region in the transfer part of the intermediate transfer recording medium with the object in its region where the ancillary product or part has been provided; and retransferring the transfer part in the intermediate transfer recording medium onto the object to form an image-formed object.

9. The method according to claim 5, wherein the object is a card.

10. The method according to claim 5, wherein the object is a booklet.

11. The method according to claim 8, wherein the ancillary product is an IC chip or a signature space and the ancillary part is a holo-CI mark.

12. An image-formed object produced by the method for image-formed object formation according to claim 8.

13. The method for image formation according to claim 5 using a thermal transfer sheet adapted for the formation of a thermal dye transfer image and/or a thermal ink transfer image on a transfer part in an intermediate transfer recording medium, said intermediate transfer recording medium comprising a substrate film and a transfer part, comprising at least a receptive layer, provided separably on the substrate film, said thermal transfer sheet being also adapted for use before the retransfer of the transfer part in the intermediate transfer recording medium onto an object, said thermal transfer sheet comprising a substrate and at least a peel-off layer provided on the substrate, said thermal transfer sheet being configured so that the transfer part in its predetermined region can be removed from the intermediate transfer recording medium by putting the thermal transfer sheet and the intermediate transfer recording medium on top of each other so that the peel-off layer in the thermal transfer sheet is brought into contact with the transfer part in the intermediate transfer recording medium and then heating the assembly wherein the thermal transfer sheet and The intermediate transfer recording medium are put on top of each other for the peel-off layer in thermal transfer sheet to be brought into contact with the transfer part in the intermediate transfer recording medium, the assembly is heated, and, within 0.8 sec after the start of the heating, the peel-off layer is separated from the transfer part.

14. The method for image formation according to claim 5, wherein the peel-off layer in the thermal transfer sheet is separated from the transfer part in the intermediate transfer recording medium at a peel angle of less than 90 degrees.

15. An image forming apparatus for forming, on an intermediate transfer recording medium, a thermal transfer image which is then retransferred onto an object, said image forming apparatus comprising:

means for disposing, in position, an intermediate transfer recording medium comprising a substrate film and a transfer part, comprising at least a receptive layer, separably provided on the substrate film and a thermal transfer sheet comprising a substrate and at least a peel-off layer provided on the substrate;

means for forming a predetermined image on an intermediate transfer recording medium;

means for transferring the predetermined image formed on the intermediate transfer recording medium onto an object; and means for, before or after the formation of the image on the intermediate transfer recording medium, removing the transfer part in its region corresponding to a non-transfer region by the peel-off layer in the thermal transfer sheet.

16. The apparatus for image formation according to claim 15, which further comprises means for putting the thermal transfer sheet and the intermediate transfer recording medium on top of each other so as for the peel-off layer in the thermal transfer sheet to be brought into contact with the transfer part in the intermediate transfer recording medium, heating the assembly, and, within 0.8 sec after the start of the heating, separating the peel-off layer from the transfer part.

17. The apparatus for image formation according to claim 15, which comprises means for separating the peel-off layer in the thermal transfer sheet from the transfer part in the intermediate transfer recording medium at a peel angle of less than 90 degrees.

18. The method according to claim 5, which comprises the step of removing the transfer part in its region, which is likely to cause flash after retransfer, by the peel-off layer.

* * * * *